US007168686B2

(12) United States Patent
Ehrenleitner

(10) Patent No.: US 7,168,686 B2
(45) Date of Patent: Jan. 30, 2007

(54) LIFTING APPARATUS

(75) Inventor: Franz Ehrenleitner, Stuttgart (DE)

(73) Assignee: Eisenmann Maschinenbau KG, Stuttgart (DE)

( * ) Notice: Subject to any disclaimer, the term of this patent is extended or adjusted under 35 U.S.C. 154(b) by 23 days.

(21) Appl. No.: 10/710,153

(22) Filed: Jun. 22, 2004

(65) Prior Publication Data

US 2005/0017229 A1 Jan. 27, 2005

(30) Foreign Application Priority Data

Jun. 25, 2003 (DE) ..... 103 28 487

(51) Int. Cl.
*B66D 1/30* (2006.01)

(52) U.S. Cl. ..... 254/371; 254/278

(58) Field of Classification Search ..... 254/371, 254/372, 373, 278, 530.1; 242/530.2, 530.1
See application file for complete search history.

(56) References Cited

U.S. PATENT DOCUMENTS 586,350 A * 7/1897 Avery ..... 212/71
4,365,767 A * 12/1982 Benthimere ..... 242/534.2
5,511,742 A * 4/1996 DeMasters ..... 242/470
6,042,087 A * 3/2000 Heinemann ..... 254/364
6,109,596 A 8/2000 Garnier
6,431,490 B1 * 8/2002 Monget et al. ..... 242/444
6,824,090 B2 * 11/2004 Imai ..... 242/332.7
6,921,061 B2 * 7/2005 Hayashi et al. ..... 254/373

FOREIGN PATENT DOCUMENTS

DE 19525921 11/1996
EP 0 082 046 A 6/1983

* cited by examiner

*Primary Examiner*—Emmanuel M Marcelo
(74) *Attorney, Agent, or Firm*—Factor & Lake, Ltd.

(57) ABSTRACT

A lifting apparatus for lifting and lowering a load comprises, in a known manner, a lifting drum and a drive, by which the lifting drum can be set in rotation in both directions. Serving as the pulling mechanisms are bands which are secured by one end to the lifting drum and at the other end carry a holding device for the load. At least two bands can be wound up on the lifting drum, by rotation of the latter, with accurate tracking and so as to lie one above the other, in such a way that all the turns of the bands lie one above the other. This lifting apparatus combines a high carrying capacity, high precision in the guidance of the bands and a high level of operating safety.

11 Claims, 4 Drawing Sheets

LIFTING APPARATUS

SUMMARY OF INVENTION

The invention relates to a lifting apparatus for lifting and lowering a load, having a) a lifting drum;

b) a drive, by which the lifting drum can be set in rotation in both directions;

c) at least two bands, serving as pulling means, which are secured by one end to the lifting drum and at the other end carry a holding device for the load;

d) the bands being able to be wound up on the lifting drum, by rotation of the latter, in such a way that one turn lies above the other.

A wide variety of configurations of lifting apparatuses employing a lifting drum and at least one flexible pulling means which can be wound up on this drum are known. Ropes, chains or bands, in particular, are used as the pulling means. Bands have the advantage that they can be wound up on the lifting drum in a particularly well-defined manner and have a relatively high carrying capacity, while nevertheless remaining sufficiently flexible. For this reason, lifting apparatuses which employ bands as the pulling means, with which the present invention is also concerned, are enjoying increasing popularity.

A plurality of load-carrying bands are generally employed in cases where the carrying capacity of the lifting apparatus is to be increased or loads with large dimensions are to be lifted and lowered. In such lifting apparatuses known from the market, the different bands were wound up on the lifting drum one beside the other, i.e. in different axial regions. However, this gives rise to geometrical problems with the band guidance, in particular where there are a large number of bands or the space is confined.

The object of the present invention is to configure a lifting apparatus of the type mentioned at the outset in such a way that, while maintaining precise guidance of the bands, a large number of bands, suited to the requirements, can be employed without much space being required for their guidance.

This object is achieved according to the invention in that e) at least two bands can be wound up on the lifting drum with accurate tracking and so as to lie one above the other.

According to the invention, the plurality of bands are thus no longer wound up one beside the other in axially different regions, but one above the other in the same axial region of the lifting drum. It is now no longer turns of one and the same band that lie directly one above the other, but turns of different bands. The winding-up behaviour of these bands lying one above the other can be controlled very well. Moreover, they can be guided in a relatively confined space. Each of the bands lying one above the other can be dimensioned in such a way that, in an emergency when another band breaks, it can take over the share of the load which has hitherto been carried by this other band and in this way emergency operation of the lifting apparatus is possible. This contributes to increased operating safety of the lifting apparatus.

Winding a plurality of bands on the lifting drum one above the other in the manner according to the invention gives rise to the problem that, on unwinding the bands from the lifting drum, at a certain angular rotation different lengths of the bands are unwound. This results from the fact that the turns of the bands, which are unwound simultaneously, lie on different radii. A configuration of the invention is therefore recommended in which the lower ends of the bands are connected to a holding device for the load, which is configured as a compensating device for the varying lengths, on winding up and unwinding, of the unwound parts of the bands lying one above the other on the lifting drum. This compensating device makes it possible for the lower ends of the bands lying one above the other to move at slightly different speeds on unwinding or winding up, without losing the uniform load distribution to the different bands.

By way of example, it is possible for two bands to be able to be wound up on the lifting drum with accurate tracking and so as to lie one above the other. In this case, the holding device can comprise a rocker element which connects the lower ends of the two bands to one another, the rocker element having, between the points at which the force is introduced by the bands, a fastening device for the load. The different vertical movements of the lower ends of the bands lying one above the other is offset by a pivoting of the rocker element.

In this case, the lower ends of the bands are expediently secured in clamping pieces articulated in opposite regions of the rocker element.

If three bands are to be able to be wound up on the lifting drum with accurate tracking and so as to lie one above the other, the following construction is possible: the lower ends of the two outer bands are connected to one another, the holding device comprising a deflection roller which is carried by the middle band and around which the connection between the two outer bands is guided. The vertical position of the holding device is in this case determined substantially by the middle band, while the vertical positions of the lower ends of the two outer bands are displaced, on unwinding and winding up, in opposite directions relative to the lower end of the middle band. As a result of the non-positive connection between the lower ends of the outer bands, the same stress is always present in these bands. The length of the middle band must be dimensioned in such a way that this band too carries substantially the same share of the load. This design presupposes, however, that at least the two outer bands have the same thickness.

The lower ends of the two outer bands can, in principle, be connected to one another in one piece, with the result that the two outer bands are formed by a single band laid around the deflection roller. A more favourable construction, however, is that in which the lower ends of the two outer bands are connected to one another by a piece of rope or chain which is guided around the deflection roller. It is thereby possible to use smaller-diameter and thus space-saving deflection rollers.

It is also possible for four bands to be able to be wound up on the lifting drum with accurate tracking and so as to lie one above the other. In this case, a design can be employed in which the lower ends of the first pair of adjacent bands and the lower ends of the second pair of adjacent bands are connected to one another, the holding device comprising:

a) a rocker element;

b) a first deflection roller, around which the connection of the lower ends of the first pair of bands is guided and which is mounted in an end region of the rocker element;

c) a second deflection roller, around which the connection of the lower ends of the second pair of bands is guided and which is mounted in the opposite end region of the rocker element; and d) the rocker element, at a point lying between the points at which the deflection rollers are mounted, having a fastening device for the load.

In this design, the two deflection rollers perform a vertical movement which corresponds to an average of the vertical movement of the two bands with which these deflection rollers are associated. Through the rocker element, in turn, a further averaging of the vertical positions of the two deflection rollers takes place.

In this latter design too, it is recommended for the reasons already mentioned above that the connections of the lower ends of the two pairs of bands are pieces of rope or chain.

The winding-up and unwinding of the bands lying one above the other involves a sliding movement of these bands relative to one another. It is therefore favourable if the bands are provided with a friction-reducing coating on at least one side, which coating may be a graphite or Teflon coating or the like.

As a result of the fact that the ends of the bands lying one above the other are fastened to the circumferential surface of the lifting drum, a step is formed which has to be overcome by the radially inner band after the first turn. In order to avoid bending of the band at this point, it is advantageous if at least one spacer element, on which the first turn of the radially innermost band can come to bear before reaching the step formed by the ends of the bands, is provided on the circumferential surface of the lifting drum.

Preferably, the bands consist of metal, in particular of steel.

BRIEF DESCRIPTION OF DRAWINGS

Exemplary embodiments of the invention are explained in more detail below with reference to the drawing, in which.

DETAILED DESCRIPTION

Figure 1:
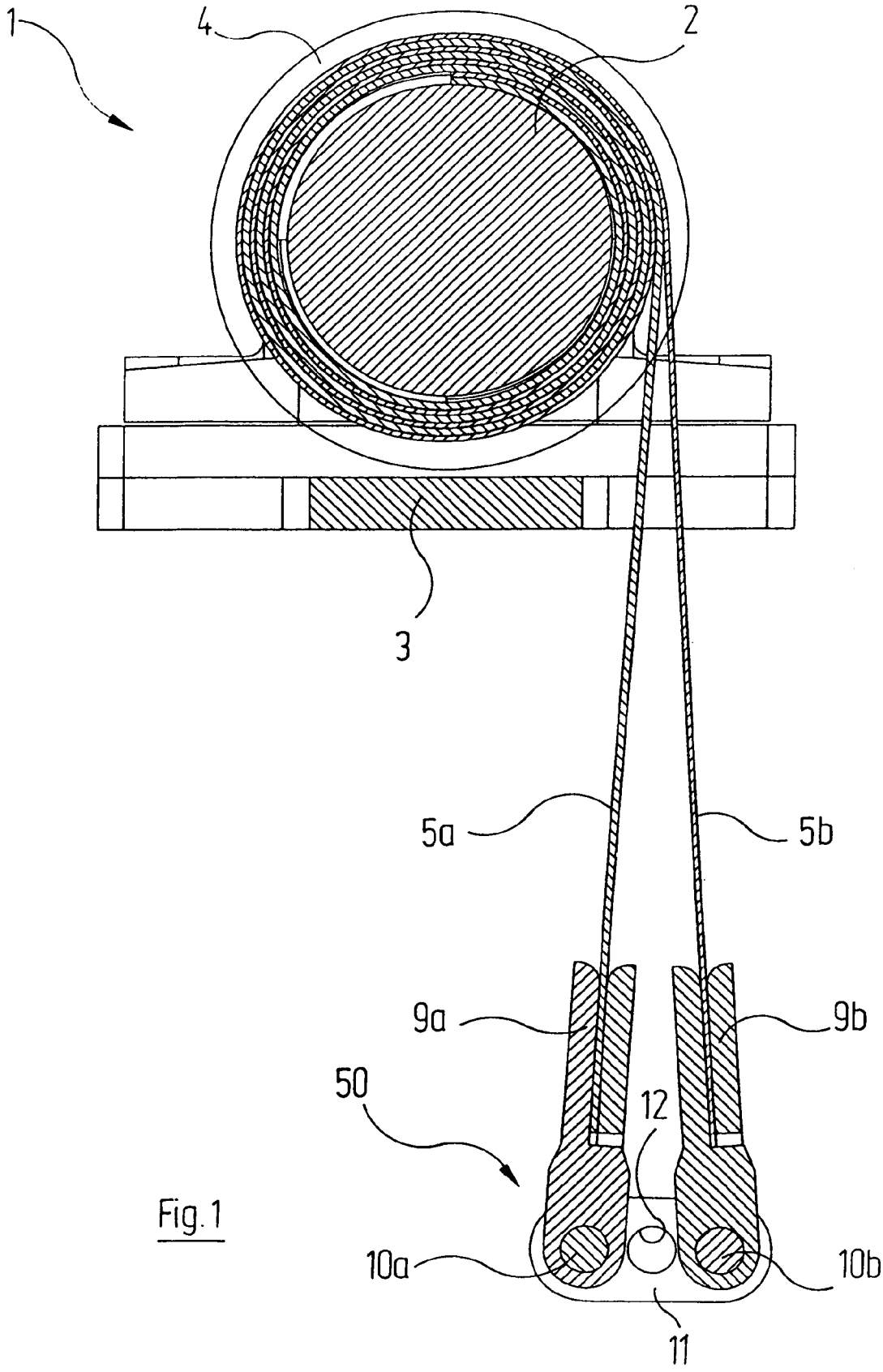
FIG. 1 shows a section through the lifting drum and two load-carrying bands of a lifting apparatus.

Reference is made first of all to FIG. 1, which can be understood as a highly schematic illustration of a simple lifting apparatus. The lifting apparatus, identified as a whole by the reference symbol 1, comprises as the main component a lifting drum 2 which is rotatably fitted in two bearing blocks 4 (only one indicated in the drawing) fixed on a mounting plate 3. The lifting drum 2 can be rotated in both directions of rotation by a drive motor (not illustrated) which is likewise mounted on the mounting plate 3.

The mounting plate 3 is placed at a certain height above the room floor, for example by means of a steel structure (not illustrated).

Figure 2:
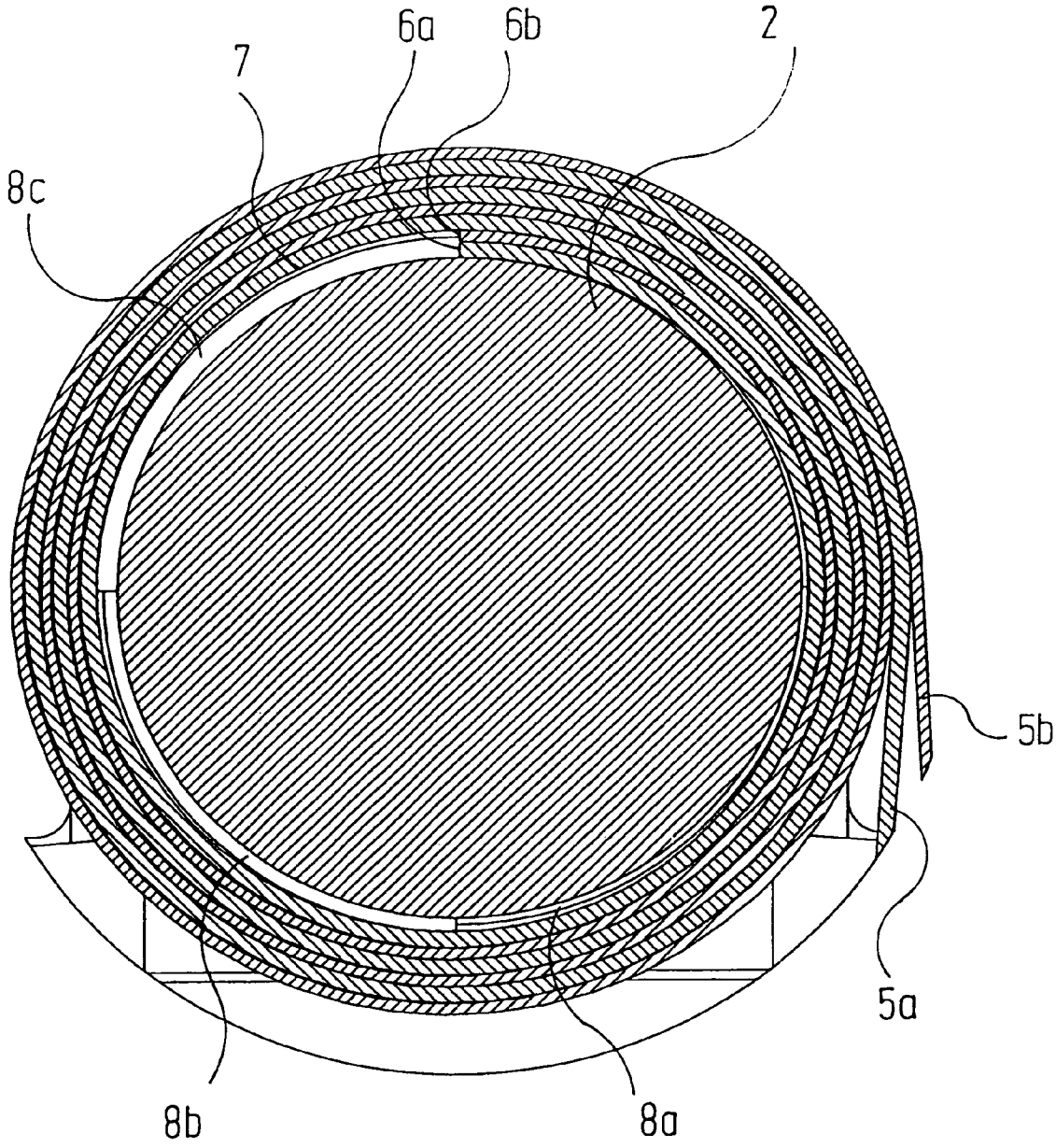
FIG. 2 shows a detail enlargement from FIG. 1.

To lift and lower the load, two steel bands 5*a*, 5*b* are used as the pulling means, which bands can be wound up on the lifting drum 2 with accurate tracking and so as to lie one above the other in a plurality of turns likewise lying one above the other, as can be seen from FIGS. 1 and 2. This means that following one another radially from the inside outwards on the lateral surface of the lifting drum 2 are first of all a turn of the steel band 5*a* on the left in FIG. 1, then a turn of the steel band 5*b* on the right in FIG. 1 and then, in accordance with the position of the load to be lifted or lowered, further turns alternately of the steel band 5*a* and of the steel band 5*b*.

As can be seen in particular from FIG. 2, the ends 6*a*, 6*b* of the two steel bands 5*a*, 5*b* are suitably secured to the lateral surface of the lifting drum 2, for example by adhesive bonding, clamping, welding or else simply by the friction produced by turns of the two steel bands 5*a*, 5*b* lying thereabove. In the latter case, the steel bands 5*a*, 5*b* must of course not be unwound from the lifting drum 2 down to the last turn in normal operation.

The ends 6*a*, 6*b* of the two steel bands 5*a*, 5*b* form a step for the first turn of the steel band 5*a* on the left in FIG. 1, which step has to be overcome by the steel band 5*a* and the height of which is equal to the sum of the thicknesses of the two steel bands 5*a* and 5*b*. This results in an empty space 7 between the first turn of the steel band 5*a* and the lateral surface of the lifting drum 2. In order to prevent the first turn of the steel band 5*a* and hence, to a certain extent, also the further turns, lying thereabove, of both steel bands 5*a*, 5*b* from being pressed into the clearance 7 and thereby bent at the step formed by the ends 6*a*, 6*b*, a total of three spacer elements 8*a*, 8*b* and 8*c* in the form of metal sheets 8*a*, 8*b* and 8*c* curved in the shape of circular arcs are arranged in this empty space 7. Each of these metal sheets 8*a*, 8*b* and 8*c* has a constant thickness. The thickness of the metal sheets 8*a*, 8*b*, 8*c* increases, however, in the clockwise direction towards the step formed by the ends 6*a*, 6*b*. Generally, the direction in which the thickness of the spacer elements 8*a*, 8*b*, 8*c* is to increase, is opposite that direction in which the lifting drum 2 rotates on lifting the load.

The spacer elements 8*a*, 8*b*, 8*c* thereby form bearing surfaces for the first turn of the steel band 5*a*, preventing this turn from "caving in" too deeply, radially inwards. It is thus not absolutely necessary for the thickness of the spacer elements 8*a*, 8*b*, 8*c* to increase continuously in the stated direction, so as to exactly fill up the empty space 7 formed geometrically. Nor do the spacer elements 8*a*, 8*b*, 8*c* have to butt against one another. They can, seen in the circumferential direction, also be at a distance, which is bridged by the steel band 5*a*. The number of spacer elements 8*a*, 8*b*, 8*c* used can vary depending on the circumstances. The result, however, is that the first turn of the steel band 5*a* and hence also the turns, lying thereabove, of both steel bands 5*a*, 5*b* undergo no bending or only insignificant bending at the step formed by the ends 6*a*, 6*b*, so that no appreciable alternating loading of the steel bands 5*a*, 5*b* occurs at this point.

Clamped to the lower ends of each of the steel bands 5*a*, 5*b* is a clamping piece 9*a*, 9*b*. The lower regions of the two clamping pieces 9*a*, 9*b* are each articulated with the aid of a bearing pin 10*a*, 10*b* at opposite end regions of a rocker element 11. The rocker element 11 has in the central region a bore 12, to which the load (not illustrated) can be attached. The rocker element 11 thereby forms with the clamping pieces 9*a*, 9*b* a holding device 50 for the load.

The operation of the lifting apparatus 1 described is as follows:

On lowering a load attached to the rocker element 11, the lifting drum 2 is rotated in the clockwise direction in FIGS. 1 and 2, whereby the two steel bands 5*a*, 5*b* unwind from the lifting drum 2. Since the steel band 5*b* has been wound up on the lifting drum 2 on a larger radius than the steel band 5*a*, at a certain angular rotation of the lifting drum 2 a longer piece of the steel band 5*b* is unwound therefrom than of the steel band 5*a*. This difference in length of the two steel bands 5*a*, 5*b* is compensated for by a corresponding tilting of the rocker element 11 about the axis defined by the bore 12. The stresses within the steel bands 5*a*, 5*b* remain substantially equal in this case, so that the load is uniformly distributed to the two steel bands 5*a*, 5*b*.

In order to reduce the mutual friction as they are wound up on and unwound from the lifting drum 2, the two steel bands 5*a*, 5*b* are provided with a low-friction coating or intermediate layer, at least on a side which can come to bear on an adjacent steel band 5*a*, 5*b* on winding up. This may be a graphite coating or a Teflon band or the like.

In the exemplary embodiment described above with reference to FIGS. 1 and 2, two steel bands 5*a*, 5*b* have been used to carry the load. If even greater loads are to be lifted and lowered, it may be necessary to increase the number of steel bands to be wound one above the other. Since it is obvious how the relationships on the lifting drum 2 would appear in such a case, a separate illustration of this has been dispensed with. What is interesting in these cases is how the respective lower ends of the steel bands are connected to one another.

Figure 3:
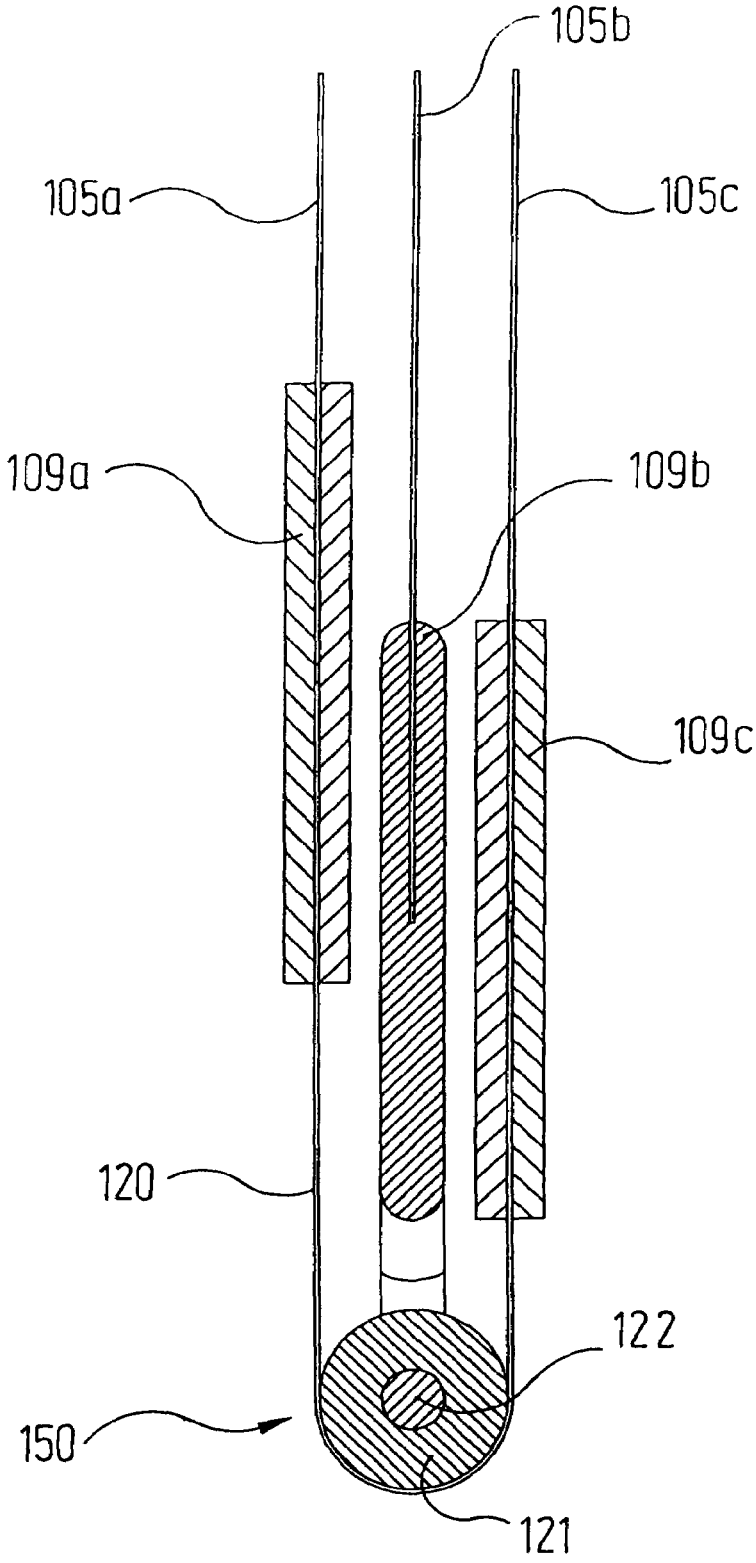
FIG. 3 shows, in section, a holding device used in lifting apparatuses employing three bands.

An exemplary embodiment of a holding device 150 which can be employed with three steel bands 105*a*, 105*b* and 105*c* is illustrated in FIG. 3. The lower ends of these steel bands 105*a*, 105*b*, 105*c* are again clamped in clamping pieces 109*a*, 109*b*, 109*c*. In addition, the two ends of a piece of rope 120, guided over a deflection roller 121, are secured in the two outer clamping pieces 109*a*, 109*c* in the manner illustrated in FIG. 3. The deflection roller 121 is rotatably mounted in the lower end region of the middle clamping piece 109*b* by means of a bearing journal 122. The load (not illustrated) is attached to the middle clamping piece 109*b* or to the bearing journal 122.

On lifting and lowering the load, its position is determined by the position of the clamping piece 109*b* clamped to the lower end of the middle steel band 105*b*. The differences in length which result on unwinding the two lateral steel bands 105*a*, 105*c* are compensated for by the clamping pieces 109*a*, 109*c* attached to their lower ends moving in opposite directions upwards and downwards, the stress present in them being transmitted via the rope 120. A uniform distribution of the load to all three steel bands 105*a*, 105*b*, 105*c* can thereby be achieved. However, this presupposes that at least the two outer steel bands 105*a*, 105*c* have the same thickness.

Figure 4:
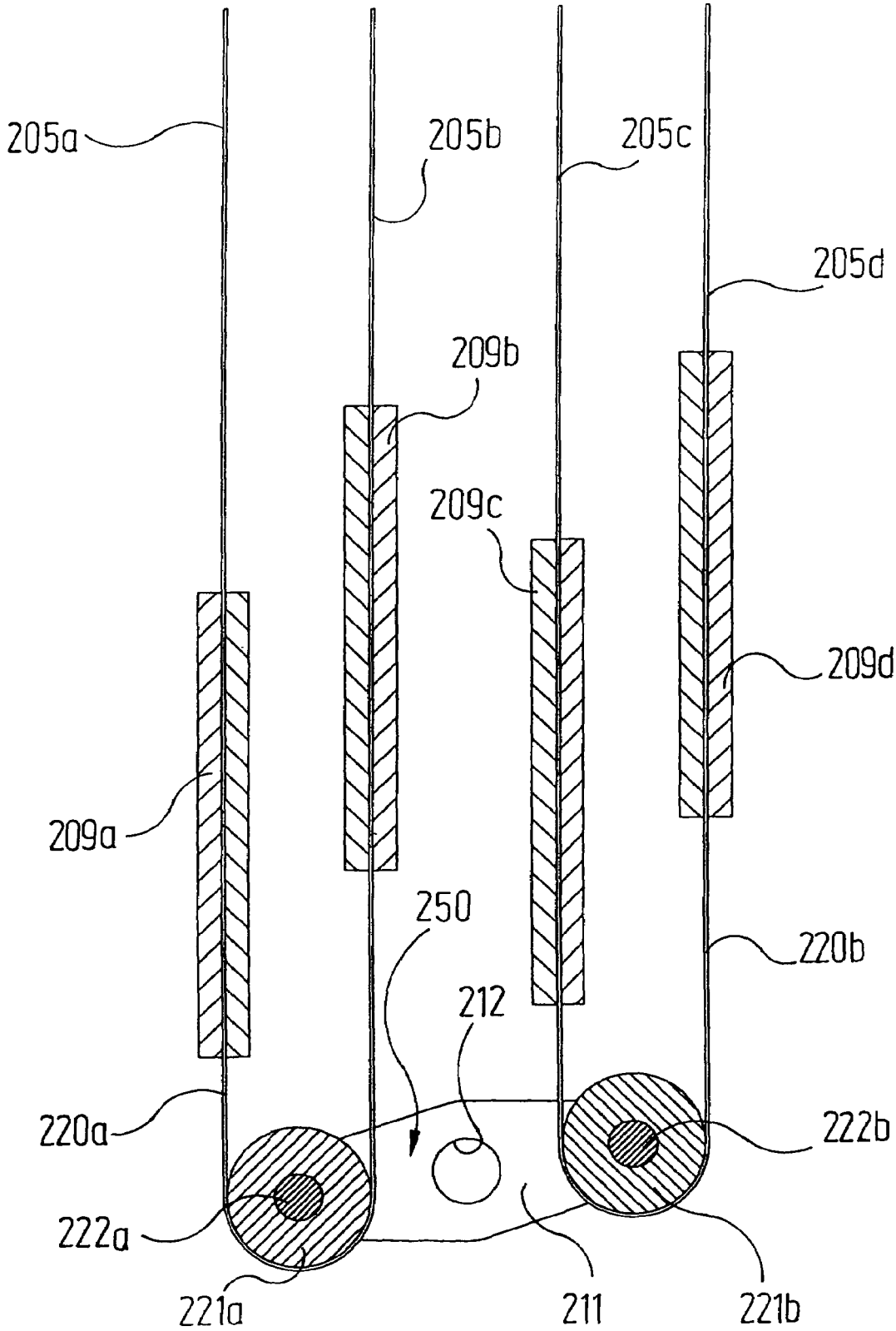
FIG. 4 shows, in section, a holding device used in lifting apparatuses employing four bands.

Finally, FIG. 4 shows how the lower ends of four load-carrying steel bands 205*a*, 205*b*, 205*c* and 205*d* can be connected to one another by a holding device 250, in order to be able to compensate for the different movements of the lower ends of the steel bands 205*a* to 205*d* while uniformly distributing the load. The holding device 250 illustrated in FIG. 4 constitutes in a way a combination of the designs described above with reference to FIGS. 1 and 3: The lower ends of the steel bands 205*a* to 205*d* are each again clamped in a clamping piece 209*a*, 209*b*, 209*c* and 209*d*. Once again, the opposite ends of a piece of rope 220*a*, guided over a first deflection roller 221*a*, are secured in the adjacent clamping pieces 209*a*, 209*b* associated with the steel bands 205*a*, 205*b*. In a corresponding manner, the opposite ends of a second piece of rope 220*b*, guided over a second deflection roller 221*b*, are clamped to the adjacent clamping pieces 209*c*, 209*d* associated with the steel bands 205*c*, 205*d*. The two deflection rollers 221*a*, 221*b* are each rotatably mounted with the aid of a bearing journal 222*a*, 222*b* in the opposite ends of a rocker element 211.

In the middle between the two journals 222*a*, 222*b*, the rocker element 211 once again has a bore 212, to which the load (not illustrated) can be attached and which forms the axis of rotation for the tilting of the rocker element 211.

The difference in length which arises on unwinding or winding up the adjacent steel bands 205*a*, 205*b* can be compensated for with the aid of the deflection roller 221*a*. Correspondingly, the difference in length which results between the steel bands 205*c*, 205*d* can be compensated for by the deflection roller 221*b*, while each time ensuring the same stress in the steel bands 205*a*, 205*b* and 205*c*, 205*d* connected via the pieces of rope 220*a*, 220*b*, respectively. Differences between the average changes in length of the band pair 205*a*, 205*b*, on the one hand, and the band pair 205*c*, 205*d*, on the other hand, are compensated for by tilting the rocker element 211 about the axis defined by the bore 212.

The invention claimed is:

1. Lifting apparatus for lifting and lowering a load, having a) a lifting drum;

b) a drive, by which the lifting drum can be set in rotation in both directions;

c) at least two bands, serving as pulling means, which are secured by one end to the lifting drum and at the other end carry a holding device for the load;

d) the at least two bands being able to be wound up on the lifting drum, by rotation of the latter, in such a way that one turn lies above the other; and, e) the at least two bands can be wound up on the lifting drum with accurate tracking and so as to lie alternatingly one on top of the other, wherein lower ends of the bands are connected to a holding device for the load, which is configured as a compensating device for the varying length, on winding up and unwinding, of the unwound part of the bands lying one above the other on the lifting drum.

2. Lifting apparatus according to claim 1, characterised in that the at least two bands can be wound up on the lifting drum with accurate tracking and so as to lie one above the other, and in that the holding device comprises a rocker element which connects the lower ends of the at least two bands to one another, and in that the rocker element has, between the points at which the force is introduced by the at least two bands, a fastening device for the load.

3. Lifting apparatus according to claim 2, characterised in that the lower ends of the at least two bands are secured in clamping pieces articulated in opposite regions of the rocker element.

4. Lifting apparatus according to claim 1, characterised in that three bands can be wound up on the lifting drum with accurate tracking and so as to lie one above the other, in that two outer bands are connected to one another and the holding device comprises a deflection roller which is carried by a middle band and around which the connection between the two outer bands is guided.

5. Lifting apparatus according to claim 4, characterised in that the lower ends of the two outer bands are connected to one another by a piece of rope or chain which is guided around the deflection roller.

6. Lifting apparatus according to claim 1, characterised in that four bands can be wound up on the lifting drum with accurate tracking and so as to lie one above the other, in that lower ends of a first pair of adjacent bands and lower ends of a second pair of adjacent bands are connected to one another, and in that the holding device comprises:

a) a rocker element;

b) a first deflection roller, around which the connection of the lower ends of the first pair of bands is guided and which is mounted in one end region of the rocker element;

c) a second deflection roller, around which the connection of the lower ends of the second pair of bands is guided and which is mounted in the opposite end region of the rocker element;

d) the rocker element, at a point lying between the points at which the deflection rollers are mounted, having a fastening device for the load.

7. Lifting apparatus according to claim 6, characterised in that the connections of the lower ends of the two pairs of bands are pieces of rope or chain.

8. Lifting apparatus according to claim 1, characterised in that at least one of the at least two bands are provided with a friction-reducing coating on at least one side.

9. Lifting apparatus according to claim 1, characterised in that at least one spacer element, on which the first turn of the radially innermost band can come to bear before reaching a step formed by the ends of the bands, is provided on the circumferential surface of the lifting drum.

10. Lifting apparatus according to claim 1, characterised in that at least one of the at least two bands include metal.

11. Lifting apparatus according to claim 10, wherein the metal is steel.

* * * * *